United States Patent [19]

Watanabe

[11] Patent Number: 4,519,601

[45] Date of Patent: May 28, 1985

[54] SHEET FEEDING APPARATUS

[75] Inventor: Junji Watanabe, Yokohama, Japan

[73] Assignee: Tokyo Shibaura Denki Kabushiki Kaisha, Kawasaki, Japan

[21] Appl. No.: 446,415

[22] Filed: Dec. 2, 1982

[51] Int. Cl.[3] ..... B65H 3/06

[52] U.S. Cl. ..... 271/114; 271/116; 271/270

[58] Field of Search ..... 271/114, 115, 116, 266, 271/270

[56] References Cited

U.S. PATENT DOCUMENTS

| | | | |
|---|---|---|---|
| 3,207,505 | 9/1965 | Nielsen et al. | 271/266 |
| 3,581,000 | 5/1971 | Hansen | 271/266 |
| 3,743,275 | 7/1973 | Miller et al. | 271/114 |
| 3,936,041 | 2/1976 | Shiina et al. | 271/116 |
| 3,966,198 | 6/1976 | Komada et al. | 271/270 |
| 4,175,694 | 11/1979 | Donabin | 271/266 |
| 4,268,021 | 5/1981 | Rutishauser et al. | 271/116 |
| 4,394,010 | 7/1983 | Hogenson | 271/114 |

*Primary Examiner*—Bruce H. Stoner, Jr.
*Assistant Examiner*—John A. Carroll
*Attorney, Agent, or Firm*—Cushman, Darby & Cushman

[57] ABSTRACT

A paper feeding device having a pulse motor controller which controls the pulse motor so that the transfer roller is decelerated in a rotational angle larger than the rotational angle due to the inertia of the drive system consisting of the transfer roller and the pulse motor, thereby suppressing over-rotation of the transfer roller due to the inertia of the drive system.

4 Claims, 8 Drawing Figures

SHEET FEEDING APPARATUS

BACKGROUND OF THE INVENTION

The present invention relates to a paper feeding device, particularly to a paper feeding device with improved reliability.

FIG. 1 is a schematic diagram of a conventional paper feeding device as used in a copying machine. In the figure, a cassette 1 containing sheets of paper P is provided removably to the main body of the copying machine (not shown). Transfer rollers 2 are provided detachably to the main body so as to be in contact with the uppermost sheet of paper P. The transfer rollers 2 are rotated by a pulse motor not shown in the figure, and carry out the sheets of paper P one by one from the cassette 1. The sheet of paper P is conveyed until its leading edge contacts the nip portion of a pair of resist rollers 3. In order to properly position the edge in the transfer direction of the sheet of paper P for subsequent smooth processing, the transfer rollers 2 are rotated slightly even after contact, so that a little slack is given to the sheet P as indicated by the two-dot broken line. Subsequently, the pulse motor is stopped.

In a paper feeding device of such construction, however, inertia of the drive system from the pulse motor to transfer rollers 2 is large. When stopping the pulse motor, the transfer rollers 2 do not stop immediately and over-rotate. Accordingly, the sheet of paper P in contact with the nip portion of resist rollers 3 may be bent or jammed.

SUMMARY OF THE INVENTION

An object of the present invention is to provide a paper feeding device with improved reliability of sheets feeding.

Another object of the invention is to provide a paper feeding device which prevents over-rotation of the transfer rollers and has relatively simple construction.

These objects may be attained by paper feeding device which comprises transfer roller means in contact with the sheet of paper for transferring it by rotation frictional force; pulse motor means for rotating the transfer roller means; and pulse motor control means for controlling the pulse motor means to decelerate the conveying roller means in a rotational angle larger than the rotational angle of the transfer roller means due to inertia of the drive system which consists of the transfer roller means and the pulse motor means.

In a sheet paper feeding device according to the present invention, the transfer roller means is decelerated in a rotational angle of the transfer roller means due to inertia of the drive system. Therefore, over-rotation of the transfer rollers can be prevented. Reliable feeding of paper is thus improved. As shown by an embodiment of the present invention, the objects of the invention are attained with relatively simple construction.

BRIEF DESCRIPTION OF THE DRAWINGS

By way of an example and to make the description clearer, reference is made to the accompanying drawings in which.

DETAILED DESCRIPTION OF THE PREFERRED EMBODIMENT

Hereinafter, a paper feeding device according to the present invention will be described with reference to the drawings.

Figure 1:
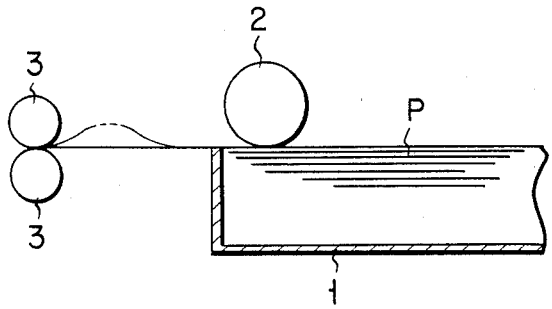
FIG. 1 (PRIOR ART)
FIG. 1 is a schematic diagram of a conventional paper feeding device as used in a copying machine.
Figure 2:
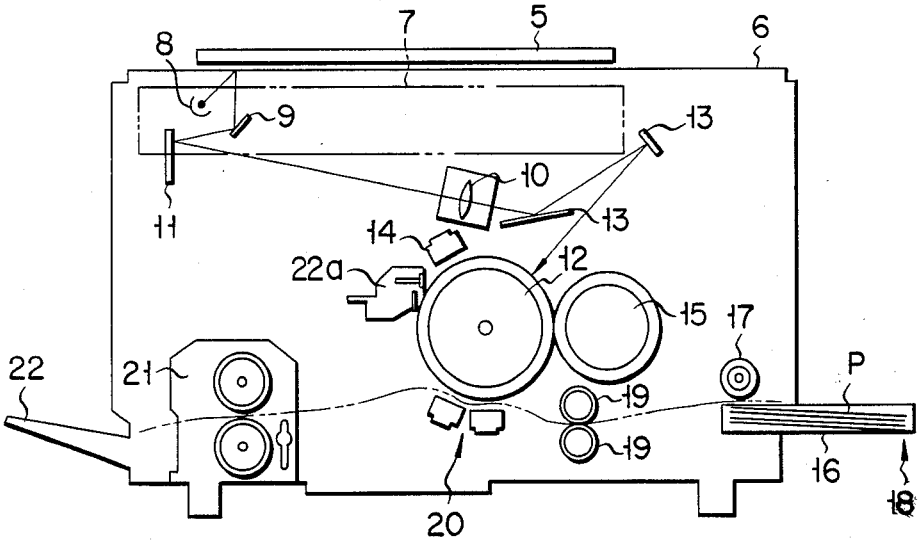
FIG. 2 is a schematic vertical sectional view of a paper feeding device as an embodiment of the present invention as applied to a copying machine.

FIG. 2 is a schematic vertical sectional view of paper feeding device as an embodiment of the present invention as applied to a copying machine. In the figure, below an original carrying table 5 secured to a copying machine 6 there is provided an optical-system drive device 7. In the drive device, a lamp 8 and a first travelling mirror 9 move together and scan the surface of an original placed on the original carrying table 5. The drive device 7 also has a second travelling mirror 11 which reflects the reflected light from the first travelling mirror 9 and thus projects it onto a lens 10 placed ahead of this mirror. The second travelling mirror 11 moves so that the length of light path from the first travelling mirror to the lens 10 stays constant.

Nearly in the middle of the copying machine 6 there is provided a photosensitive body 12. An image of the original illuminated with the lamp 8 is formed on the surface of this photosensitive body via the optical-system drive 7, the lens 10 and two fixed mirrors 13. Near the photosensitive body 12 there is provided a charging device 14. On the surface of the photosensitive body 12 charged with this charging device 14, the electrostatic latent image is formed due to the illumination at the time of image formation. This electrostatic latent image is then made apparent by attaching a developing agent from a developing device 15.

On the end of the copying machine 6 there is provided a paper feeding device 18 which consists of a cassette 16 containing sheets of paper P and transfer rollers 17, etc. The sheet of paper P carried out from the paper feeding device 18 is brought in touch with a pair of resist rollers 19 and positioned properly. It is then carried over to the peripheral face of the apparent image formed on surface of the photosensitive body 12. A transcribing device 20 transfers the developing agent making up the apparent image onto the sheet of paper P carried over to this point. The image on this sheet of paper P is then fixed with a fixing device 21, and the sheet of paper P is taken out into a tray 22.

Near the photosensitive body 12 there is provided a cleaning device 22*a*. After transcribing the image, the photosensitive body 12 is cleaned with this cleaning device 22*a*. In the figure, the two-dot broken line indicates a path of conveyance of the sheet of paper P.

Figure 3:
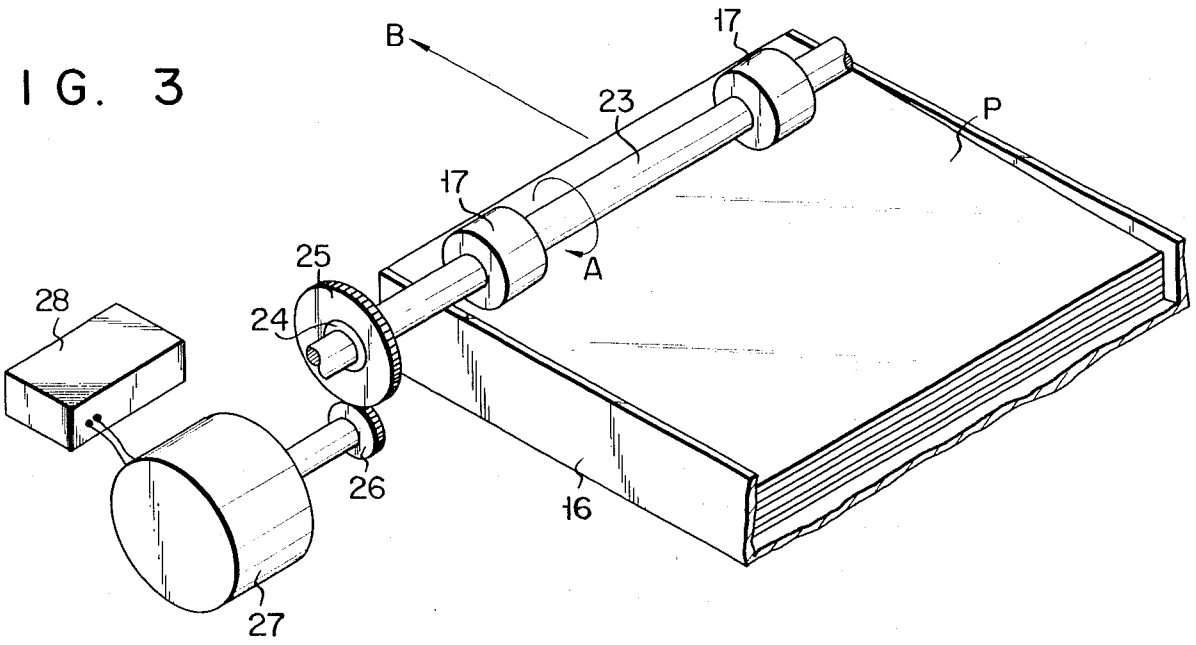
FIG. 3 is a schematic perspective view of a paper feeding device as an embodiment of the present invention.

Next, the paper feeding device 18 will be described in detail. FIG. 3 is a schematic perspective view of a paper feeding device as an embodiment of the present invention. In the figure, sheets of paper P are contained in a cassette 16 removably set in a copying machine 6. In the upper portion of this cassette 16 there is a pivotal shaft 23 rotatably supported. Onto this shaft 23 there are secured transfer rollers 17 to rotate as one piece with the shaft. The transfer rollers 17 are constantly in contact with the uppermost sheet of paper P. At one end of the shaft 23 there is provided a drive gear 25 through a one-way clutch 24. The drive gear 25, due to the action of the one-way clutch 24, is able to transmit driving force to the shaft 23 only when the shaft rotates in the direction of arrow A. Driving force is given to the drive gear 25 through a motor gear 26 secured onto a shaft of a pulse motor 27. The pulse motor 27 is controlled by a control means 28.

Next, the control means 28 will be described in detail. In carrying out the sheet of paper P in the direction of arrow B by rotating the transfer rollers 17 in the direction of arrow A by operating the pulse motor 27 without using the control means 28, when the pulse motor 27 is stopped, the transfer rollers 17 are over-rotated due to inertia of the drive system. And furthermore, since the transfer rollers 17 rotate freely at one with the shaft 23 in the direction of arrow A due to action of the one-way clutch 24, the amount of over-rotation becomes relatively large. The quantity of over-rotation $\theta r$ can be obtained by solving accurately an equation of motion for a rotational motion system represented generally as equation (1).

$$I\frac{d^2\theta}{dt^2} = -Tf \tag{1}$$

In the equation (1) , I is a moment of inertia, $\theta$ a rotational angle, and Tf is a friction torque which varies with the rotation speed.

Figure 4:
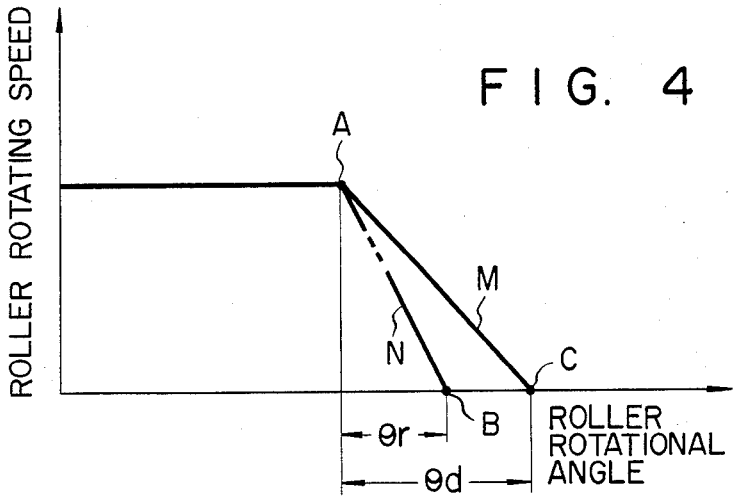
FIG. 4 is a diagram showing the deceleration characteristics of the transfer rollers in FIG. 3.

The control means 28 controls the pulse motor 27 so that over-rotation of the transfer rollers 17 is absorbed by decelerating the transfer rollers 17 in the range of a rotational angle (hereafter, referred to a deceleration quantity) $\theta d$ larger than the rotational angle $\theta r$ of the transfer rollers 17, over-rotated as indicated in FIG. 4. That is, over rotation is that rotation of transfer roller 17 caused by inertia and not resulting by driving pulse motor 27. In the figure, the two-dot line N indicates a transient response of the transfer rollers running freely due to inertia when the pulse motor 27 is stopped at the point A. In this case, control of the pulse motor 27 must be made at a point before the point A. Accordingly, the stop point B of the transfer rollers fluctuates largely, so that the precision of the stop point becomes very low. The solid line M indicates a characteristic when the pulse motor 27 is so controlled that the transfer rollers 17 at a point A are decelerated gradually to a predetermined stop point C. In this case, because the pulse motor 27 is slowly decelerated, over-rotation of the transfer rollers 17 is minimized. That is, pulse motor 27 controls the rotation of transfer roller 17 all the way to point C, thus eliminating over rotation caused by inertia.

Figure 5:
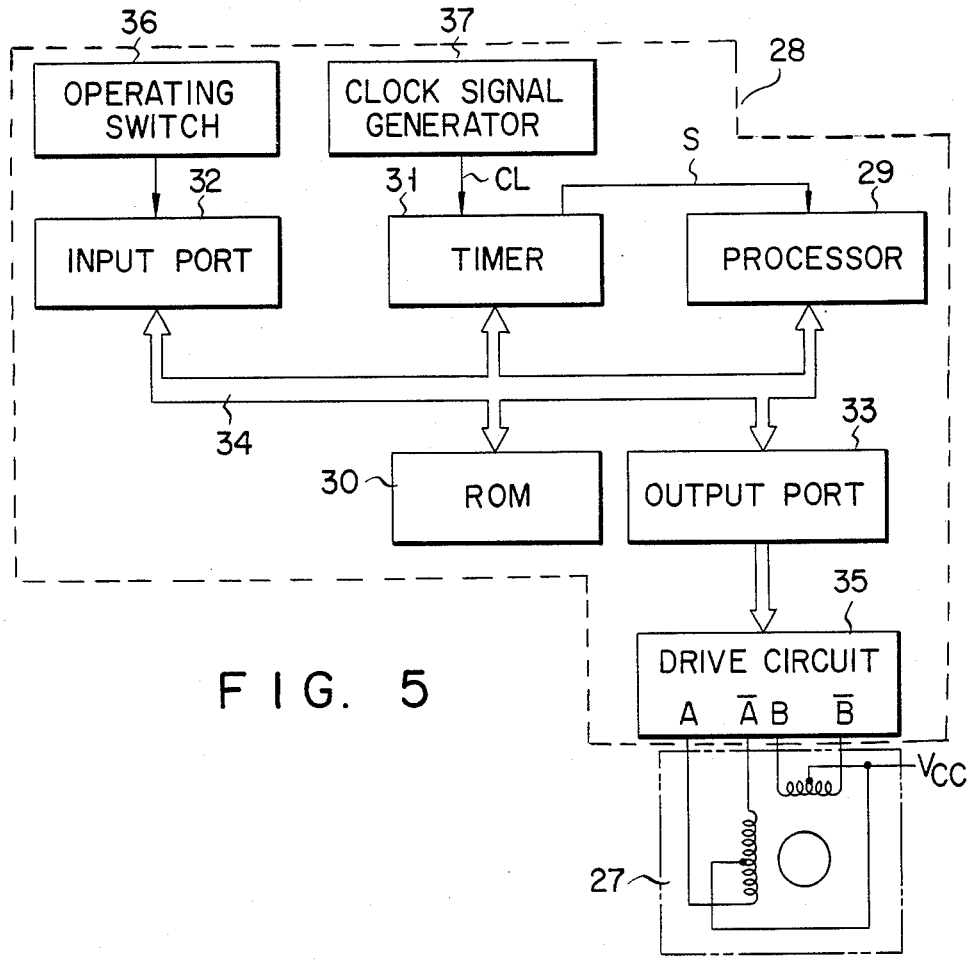
FIG. 5 is a schematic diagram of the control means in FIG. 3.

FIG. 5 is a schematic block diagram illustrating the structure of the control means 28. A processor 29, a ROM 30, a timer 31, an input port 32 and an output port 33 are connected to a data bus 34. A drive circuit 35, according to output signals from the output port 33, changes consecutively a current flowing to the winding of the stator in a pulse motor. To the pulse motor 27 a voltage Vcc is impressed from an external power source not shown in the figure.

The input port 32 is connected to an operating switch 36, and according to a start signal from the operating switch 36 it sends a signal indicating the start of drive of the pulse motor 27. The pulse motor 27 has phase terminals A, $\overline{A}$, B, and $\overline{B}$, and is driven by a two-phase excitation method, for example. In this scheme, the pulse motor 27 is excited by changing excitation phase voltages applied to the phase terminals in specific pulse intervals (also referred to as phase change times) ti (t1~tn) as illustrated in FIGS. 6A through 6D. In the figures, hatched portions are the excitation phase voltages. The timer 31 counts clock signals CL from the clock signal generating circuit 37. When the value of this count has become equal to a data set in advance, the timer sends a time-up signal S as an interruption signal to the processor 29.

Figure 7:
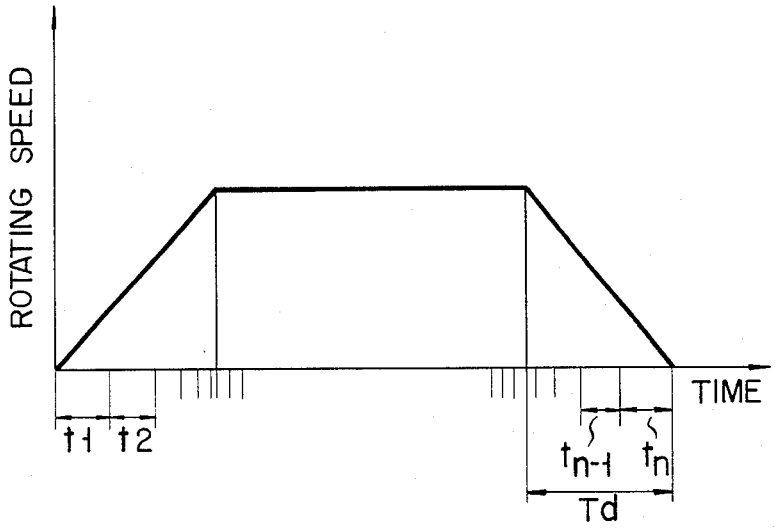
FIG. 7 is a chart for explaining performance of the pulse motor in FIG. 5.

When receiving this interruption signal, the control means 28 outputs to the drive circuit 35 a control signal so that, as illustrated in FIG. 7, the pulse motor 27 is accelerated for a specific time in starting, and decelerated for a specific time up to the stop. That is, in order to decelerate the rotating speed and stop the pulse motor in a range Td (hereafter, referred to as the deceleration interval) corresponding to the deceleration quantity $\theta d$ of the transfer rollers 17, the phase change time ti is set to be consecutively longer in the deceleration interval Td. Such a phase change time ti (t1~tn) is divided beforehand by a clock period time tc in the clock generating circuit 37, and these respective values ti/tc (t1/tc~tn/tc) as time set data are stored in the ROM 30. The time set data ti/tc (t1/tc~tn/tc) is set consecutively in the timer 31 through the processor 29 and the data bus 34. The cumulative value of drive times of the pulse motor 27 i.e. phase change times ti, $$\sum_{i=1}^{n} ti,$$

is so set that when the pulse motor 27 stops the sheet of paper is carried to a specific position.

Figure 6:
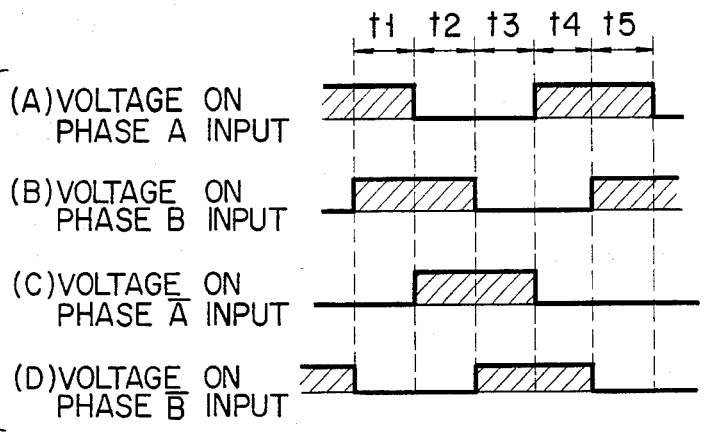
FIGS. 6A through 6D are time charts of the excitation voltages applied to phase terminals of the pulse motor in FIG. 5.
Figure 8:
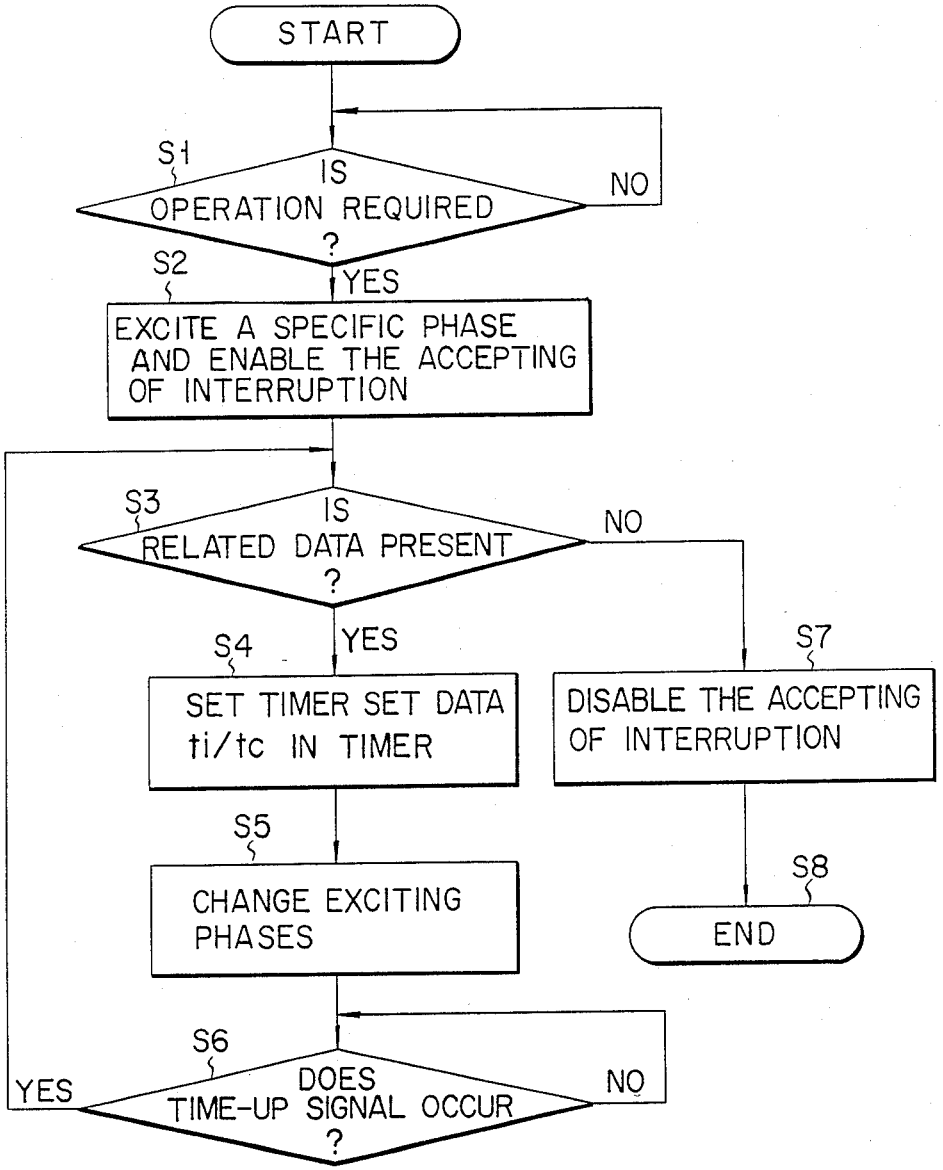
FIG. 8 is a flowchart for explaining operation of the control means in FIG. 5.

Operation of the control means 28 constructed as above will be explained referring to a flowchart in FIG. 8. When the operating switch 36 becomes on, this output signal is inputted in the processor 29 through the input port 32. When this signal is inputted, the processor 29 makes the decision of starting the paper feeding device (step S1). The processor 29 thus sends a control signal to the output port 33, so that a voltage is applied from the drive circuit 35 to specific terminals of the pulse motor 27, A and B phase terminals, for instance as illustrated in FIGS. 6A and 6B (step S2). In this case, the phase of voltage applied to the specific phase terminals corresponds to that in the stop position of the pulse motor 27. These data are constantly stored in a main memory in the processor 29. And, the processor 29 keeps itself able to accept the interruption, so as to detect the time-up signal from the timer 31 (step S2).

Then, the processor 29 refers to time set data ti/tc stored in the ROM 30 and sets a first timer set data ti/tc in the timer 31 (step S4) when the timer set data ti/tc is valid, i.e. the pulse motor 27 is excited (step S3). The processor 29 then outputs a signal of changing the excitation phase to the output port 33 to apply a phase voltage to the terminals B and $\overline{A}$ (step S5).

When in the timer 31 the set time ti/tc has elapsed, a time-up signal S is outputted from the timer 31. The processor 29 receives the time-up signal S as an interruption signal (step S6). The processor 29 then sets a second timer set data t2/tc stored in the ROM 30 in the timer 31 (step S4) and sends a signal of changing-over to the output port 33 so as to apply an excitation phase voltage to the phase terminals $\overline{A}$ and $\overline{B}$ (step S5). When the excitation phase is changed over in this manner, the rotor of the pulse motor 27 begins to start and the sheet of paper P is carried in the direction of arrow B in FIG. 3 by the transfer rollers 17 rotated by the rotor.

The order of changing over excitation phase voltages is determined by the direction of rotation of the pulse motor 27. Setting timer set data ti/tc is set consecutively in the timer 31, as above, according to the program in the processor 29 while excitation phase are changed over consecutively as in FIGS. 6A through 6D, and the pulse motor 27 is driven at a speed inversely proportional to the phase change time ti (t1 ~ tn) as illustrated in FIG. 7. Accordingly, since in the deceleration interval Td the phase change time ti is so set to be successively longer, the rotating speed of the pulse motor 27 is decelerated consecutively. Consequently, the transfer rollers 17 rotated by the pulse motor 27 are decelerated consecutively in a range corresponding to the deceleration quantity $\theta$d, and they finally come to a stop. As seen, because the transfer rollers 17 stop in a deceleration quantity $\theta$d which has a rotational angle larger than the over-rotation quantity $\theta$r, the transfer rollers do not over-rotate. Therefore, the sheet of paper P can be carried out precisely to a specific position, so that bending of the sheet of paper or paper jamming in the vicinity of the resist roller is prevented.

In the above embodiment, the case of stopping the transfer rollers after deceleration has been described. The present invention, however, is not limited thereby. The invention is also applicable to the case of decelerating the conveying rollers up to a specific speed and then speeding them up again. It is believed obvious that various changes and modifications may be made in the invention without departing from the spirit and scope thereof.

What is claimed is:

1. A sheet feeding apparatus comprising:

transfer roller means for conveying the sheet by utilizing rotation frictional force;

one-way clutch means, connected to said transfer roller means, for rotating said transfer roller means intermittently in one direction;

step motor means for rotating said transfer roller means via said one-way clutch means thereby conveying the sheet along a given path; and motor control means for gradually decelerating said step motor means at a rate to cause a rotation angle of said transfer roller means during deceleration to be greater than an overdrive rotation angle determined by inherent inertia of said transfer roller means and said one-way clutch means.

2. A sheet feeding apparatus according to claim 1, wherein said motor control means comprises:

clock signal generating means for generating clock signals;

read-only memory means for storing a plurality of time data in which said step motor means is excited, the plural time data causing said transfer roller means to stop and the sheet of paper P to be conveyed to a specific position;

timer means connected to said read-only memory means and said clock signal generating means for sending a coincidence signal when the data from said memory means and the value of count for clock signal coincide;

processor means connected to said timer means and said read-only memory means for reading out a next data in said read-only memory means and setting this in said timer means when the coincidence signal from said timer means is inputted, and simultaneously for sending a signal of changing over the excitation phase to said step motor means in a predetermined order; and drive means for sending a specific drive signal to said step motor means according to the changing-over signal from said processor means.

3. A sheet feeding apparatus according to claim 2, wherein each of the time data stored in said read-only memory means is the excitation time for the excitation phase in consecutive change-over ti (i=1, 2, 3, . . . , n) divided by the time of a clock period tc in said clock generating means.

4. A sheet feeding apparatus according to claim 3, wherein the time data stored in said read-only memory means are so set that in the deceleration interval the excitation time ti is successively larger.

* * * * *